United States Patent [19]

Okumura et al.

[11] 4,142,984

[45] Mar. 6, 1979

[54] PROCESS FOR IMPROVING GRANULAR DETERGENTS

[75] Inventors: Osamu Okumura, Funabashi; Hiroshi Nishio, Chiba; Takashi Ikeuchi, Funabashi; Izumi Yamane, Yokohama, all of Japan

[73] Assignee: The Lion Fat & Oil Co., Ltd., Tokyo, Japan

[21] Appl. No.: 848,143

[22] Filed: Nov. 3, 1977

[30] Foreign Application Priority Data

Nov. 9, 1976 [JP] Japan ..... 51-133798

[51] Int. Cl.[2] ..... C11D 7/56

[52] U.S. Cl. ..... 252/105; 252/89 R; 252/381; 252/383; 252/385; 252/530; 252/534; 252/540

[58] Field of Search ..... 252/105, 106, 89, 381, 252/383, 385, 530, 533, 534, 540

[56] References Cited

U.S. PATENT DOCUMENTS

| | | | |
|---|---|---|---|
| 3,932,316 | 1/1976 | Sagel et al. | 252/383 |
| 3,940,341 | 2/1976 | Gray et al. | 252/105 |
| 4,000,094 | 12/1976 | Fleming et al. | 252/383 X |

*Primary Examiner*—Mayer Weinblatt

*Attorney, Agent, or Firm*—Blanchard, Flynn, Thiel, Boutell & Tanis

[57] ABSTRACT

A process for improving the physical properties of granular detergents comprises making fine particles of calcium sulfite adhere uniformly onto the surface of the granular detergent. The amount of said calcium sulfite particles to be thus applied is in the range of from about 0.5 to about 5 wt.% relative to the granular detergent, and about 70 wt.% or less of this amount may be replaced with fine particles of alumino silicate. The applicable average particle diameter of calcium sulfite to be made to adhere onto granular detergent is less than about 4 $\mu$ and that of aluminosilicate is less than about 5 $\mu$.

6 Claims, No Drawings

PROCESS FOR IMPROVING GRANULAR DETERGENTS

BACKGROUND OF THE INVENTION

The present invention relates to a process for improving the physical properties of granular detergents, and to be more precise, it relates to a process for improving the physical properties, particularly the caking property under pressure or a humid atmosphere, of non phosphate or low phosphate granular detergents containing a low percentage of phosphate, by making fine particles of calcium sulfite adhere to the surface thereof.

In the case of conventional granular detergents which contain a large amount of polyphosphates as principal inorganic builder, on account of the characteristics of the polyphosphates builder, the powdery properties thereof, such as the free flowing property and the ability to prevent caking due to moisture adsorption, and compression, etc., are satisfactory and no particular troubles have been encountered. However, since a demand for reduction of the phosphorus content of detergents has grown in recent years, the circumstances have greatly changed.

As a builder replacement for phosphates, sodium silicates, carbonate or bicarbonate have held an important position in the art. However, although these substances are admittedly capable of fulfilling the function as a builder related to detergency, their efficiency for imparting satisfactory physical properties to the granular detergent is inferior to the polyphosphate builders. Consequently, they have the drawback that they produce granular detergents having poor physical properties and therefore they cannot practically be used in large amounts. As the art of improving the caking property due to moisture absorption with respect to non phosphate or low phosphate granular detergent, there are known various processes for improving the characteristics of the surface of the granular detergent by covering the exterior of the granulated detergent with some non-hygroscopic builder, metallic soap or water-insoluble substance (cf. U.S. Pat. Nos. 3,950,275, 3,925,266 and 3,989,635). However, although all of these known processes are admittedly effective in preventing the caking of the granular detergents owing to moisture absorption, they have not always been satisfactory because they involve various shortcomings such as the complexity of process, the difficulty of obtaining homogeneous products, the solubility of the detergent, the caking characteristic at the time of storage over a long period of time, and so forth.

The inventors have conducted a series of studies on fine particles insoluble in water and/or slightly soluble in water which might be usable as a surface characteristic improver for granular detergents and have come to a finding that calcium sulfite would display an excellent efficiency in improving the physical properties of granular detergents and particularly in disintegrating agglomerated detergents which solidify under a slight pressure, such as the dead load of the detergent per se, owing to moisture absorption to the initial state of the granular detergent, or the so-called "caking preventability by compression at the time of absorbing moisture." The present invention has been accomplished on the basis of this finding.

SUMMARY OF THE INVENTION

The process for improving granular detergents according to the present invention comprises making fine particles of calcium sulfite having an average particle diameter of 4μ or less adhere firmly and uniformly to the whole surface of the granulated detergent containing at least one kind of anionic surface active agent and at least one kind of inorganic builder to the extent of an equivalent amount of 0.5–5 wt.%, based on the weight of said granular detergent. In the present invention, about 70 wt.% or less of said calcium sulfite particles adhered to the granular detergent can be replaced by fine particles of aluminosilicate having an average particle diameter of less than 5μ.

DETAILED DESCRIPTION OF THE INVENTION

The average particle size of granular detergents is usually in the range of about 300 to 600μ. The present invention is intended to improve the physical properties of granular detergents such as the free flowing property, the ability to prevent caking caused by moisture adsorption, the ability to prevent compression caking caused by compression, etc., and especially improve the compression caking preventability under a humid atmosphere, by making finely pulverized calcium sulfite adhere firmly and uniformly onto the surfaces of the detergent granules. Usually, granular or powdery substances are mostly charged with negative electricity when made to flow, but granular detergents would have their surface charged with positive electricity by friction. On the other hand, the fine particles of calcium sulfite are charged with negative electricity by friction, and therefore, by merely admixing granular detergents with calcium sulfite particles, said calcium sulfite particles can be made to adhere to the surface of every detergent granule uniformly without employing any binder. The same effect can be expected in the case where a portion of said calcium sulfite not exceeding about 70 wt.% is replaced with aluminosilicate having an average particle diameter of 5μ or less. However, in the case where such a binder as water is employed or the detergent surface is made sticky in an attempt to make said fine particles of calcium sulfite adhere firmly to the surface of detergent, there would be brought about agglomeration of the detergent granules alone or calcium sulfite alone, and therefore it is undesirable.

When the average particle diameter of the calcium sulfite particles employed is about 4μ, or less, the physical properties such as the free flowing property, the ability to prevent caking caused by compression, the ability to prevent hygrocaking caused by moisture adsorption, etc. can be improved and, at the same time, the compression caking preventability under humid atmosphere can be improved. When the average particle diameter is large exceeding about 4μ, the physical properties of granular detergent become worse, and therefore it is inappropriate. The appropriate amount of calcium sulfite particles to be employed is in the range of about 0.5 to 5 parts by weight relative to 100 parts by weight of the granular detergent. When the amount of calcium sulfite particles employed is less than this, the effect would be insufficient, while in the case where it is more than this, the physical properties of the granular detergent would be deteriorated instead of improving. Besides, in the case where aluminosilicate is alone employed independently, it is not always capable of satisfactorily improving the compression caking of detergents under humid atmosphere, but the aluminosilicate can be used in combination with calcium sulfite without impairing the effect of the present invention as long as it is employed in a form of a mixture of about 30 wt.% or more of the calcium sulfite particles and about 70 wt.% or less of the aluminosilicate particles, in an amount of 0.5 to 5 parts by weight of the mixture based on 100 parts by weight of the granular detergent. As the desirable aluminosilicate for use on this occasion, there can be mentioned synthetic zeolite having an average particle diameter of 5μ or less and containing substantially no particles having a diameter of more than about 10μ.

Anionic surface active agents suitable for use in the present invention include (a) alkylbenzene sulfonates wherein the alkyl has 8 to 15 carbon atoms, (b) alkyl sulfates wherein the alkyl has 8 to 18 carbon atoms, (c) alkyl ether sulfates wherein the alkyl has 8 to 18 carbon atoms and containing an average of 1 to 8 ethylene oxide units added thereto, (d) α-olefin sulfonates having 12 to 22 carbon atoms (namely, a mixture of alkene sulfonates, hydroxyalkane sulfonates, etc.), (e) alkane sulfonates obtained from paraffin having 12 to 22 carbon atoms, (g) salts of higher fatty acids, (h) salts of condensates of higher fatty acids and taurine (namely, N-acylaminoethane sulfonate), (i) salts of sulfosuccinic acid dialkyl ester, etc. Further, these anionic surface active agents are preferably in the form of their alkali metal salts, and in the case of sulfonate or sulfate type anionic surface active agents, they may be employed in the form of their magnesium salts. The amount of said anionic surface active agent to be employed is the same as that for conventional detergents, that is, it is to be contained in the granular detergent to the extent of about 10 to 40 wt.%.

As the inorganic builder, silicates, carbonates, bicarbonate, tripolyphosphate, pyrophosphate, etc. are useful, and such an inorganic builder is contained in the granular detergent normally to the extent of 10–80 wt.%. The content of polyphosphate builder is preferably less than 15 wt.% of the granular detergent in terms of $P_2O_5$, and therefore it is desirable that the granular detergent of the present invention contain about 5 to 20 wt.% of alkali metal silicate ($M_2O.XSiO$, wherein X = 2.0 to 3.6, M represents Na or K) as one ingredient of the inorganic builder.

Other ingredients of granular detergent may be employed in the present invention are: (I) other surface active agents such as, for instance, non-ionic surface active agents including polyoxyethylene alkyl ethers, polyoxyethylene alkylphenol ethers, polyoxyethylene fatty acid esters, sorbitan fatty acid ester polyoxyethylene ether, sucrose fatty acid esters, fatty acid alkylol amides, etc., and amphoteric surface active agents of betaine type, e.g., lauryl betaine, etc., alanine type surfactants and imidazoline type surfactants; (II) organic builders such as, for instance, citrates, malates, tartrates, maleate polymers, alkyl substituted succinates, oxydiacetates, etc.; and (III) other additives such as, for instance, water soluble sulfates, anti-redeposition agents (namely, carboxymethyl cellulose, polyethylene glycol, polyvinyl alcohol, etc.), foam-controlling agents, fluorescent whitening, agents, bleaching agents, dyes, perfumes, etc. These additives are to be contained in the final products to the extent of less than about 50 wt.%.

A granulated detergent containing anionic surface active agent and inorganic builder is manufactured preferably by the spray-drying process. Adhesion of fine calcium sulfite particles (including a mixture of calcium sulfite particles and alumino silicate particles) onto the granular detergents can be effected by means of, for instance, a known mixing machine such as rotary mixer, oscillating mixer, etc., or a known granulating machine such as dish-type granulator, drum-type granulator and oscillating granulator.

Hereunder will be explained the present invention in the concrete with reference to examples embodying the invention.

EXAMPLES

Varieties of granular detergents having an average particle size in the range of about 350 to 450μ and a composition shown in Table-1 below, respectively, were manufactured by the spray-drying process. Subsequently, after adding calcium sulfite particles as specified in Table-2 below to 100 parts by weight of each of these granular detergents and admixing therewith by means of a V-type mixer for 5 minutes thereby to make said calcium sulfite particles adhere to the surface of detergent granules sufficiently, the free flowing property, the hygrocaking preventability caused by moisture adsorption, and the caking preventability caused by compression under humid atmosphere were measured. The results were as shown in Table-2.

Table 1

| Composition of Granular Detergents (wt. %) | A | B | C |
|---|---|---|---|
| sodium alkylbenzene sulfonate (R: about $C_{12}$) | 10 | 10 | 5 |
| sodium α-olefin sulfonate (R: $C_{14}$ – $C_{16}$) | 10 | 5 | 20 |
| sodium alkyl ether sulfate (R: $C_{11}$ – $C_{15}$, P: about 3) | 5 | 5 | 0 |
| sodium alkyl sulfate (R: $C_{12}$ – $C_{15}$) | 0 | 0 | 5 |
| sodium tripolyphosphate | 15 | 0 | 0 |
| sodium pyrophosphate | 0 | 12 | 0 |
| sodium silicate ($Na_2O$ . 2 . $5SiO_2$) | 13 | 10 | 15 |
| sodium carbonate | 0 | 0 | 35 |
| sodium sulfate | 35 | 48 | 9 |
| a small amount of additive* | 2 | 2 | 3 |
| water | 10 | 8 | 8 |
| total | 100 | 100 | 100 |

Remark
*Said small amount of additive includes carboxymethyl cellulose, foam-controlling agent and fluorescent whitening agent.

Table 2

| Test No. | Properties of Granular Detergent after Processing 1* | 2 | 3 | 4 | 5* | 6 | 7* | 8* | 9 | 10 | 11* | 12 | 13 | 14* |
|---|---|---|---|---|---|---|---|---|---|---|---|---|---|---|
| Composition of granular detergent | A | A | A | A | A | A | A | B | B | B | C | C | C | A |
| Calcium sulfite average particle diameter (μ) | 1.7 | 1.7 | 1.7 | 1.7 | 1.7 | 3.5 | 6.0 | — | 1.7 | 3.5 | — | 1.7 | 3.5 | 0.7** |
| Calcium sulfite added amount (part by weight | 0.1 | 0.5 | 3.0 | 5.0 | 7.0 | 3.0 | 3.0 | 0 | 2.0 | 2.0 | 0 | 2.0 | 2.0 | 3.0 |
| Free flowing property (angle of repose: degree) | 55 | 43 | 37 | 40 | 50 | 40 | 50 | 65 | 40 | 40 | 70 | 40 | 45 | 40 |
| Caking preventability by moisture adsorption (amount of coagulations: wt. %) | 70 | 35 | 30 | 20 | 20 | 35 | 60 | 80 | 35 | 40 | 85 | 35 | 45 | 20 |
| Caking | | | | | | | | | | | | | | |

Table 2-continued

| Test No. | | Properties of Granular Detergent after Processing | | | | | | | | | | | | | |
|---|---|---|---|---|---|---|---|---|---|---|---|---|---|---|---|
| | | 1* | 2 | 3 | 4 | 5* | 6 | 7* | 8* | 9 | 10 | 11* | 12 | 13 | 14* |
| preventability by compression under humid atmosphere (dyn/cm$^2$) | water content 12% | 2.3 | 1.0 | 0.5 | 0.5 | 0.5 | 0.5 | 1.7 | 2.5 | 0.7 | 0.8 | 3.0 | 0.8 | 1.0 | 1.0 |
| | water content 16% | 4.7 | 1.5 | 0.5 | 0.5 | 0.5 | 0.5 | 3.0 | 5.1 | 0.9 | 1.6 | 5.5 | 1.0 | 1.5 | 2.5 |

Remarks
*Test Nos. 1, 5, 7, 8, 11 and 14 are comparative examples.
**Synthetic zeolite was employed in lieu of calcium sulfite.

The caking preventability by moisture adsorption and the caking preventability by compression under humid atmosphere were evaluated by the following test methods. Caking preventability by moisture adsorption:

The ability of the detergent to withstand caking caused by absorbing moisture was evaluated by charging sample detergent granules into a carton for detergent (measuring 22 cm × 15.5 cm × 5.5 cm and having a water vapor permeability of 300 g/m$^2$0.24 hr), permitting the thus charged carton to stand for 3 days in a constant humidity chamber under a relative humidity of 100% and a temperature of 35° C., then cutting open the carton, sifting the contents thereof carefully through a 4-mesh sieve while oscillating the sieve gently, and calculating the ratio of the weight of detergent granules that remained on the sieve to that of the total weight of the sample particles tested.

Caking Preventability by Compression under Humid Atmosphere

The ability of the detergent to withstand caking caused by compression under humid atmosphere was evaluated by permitting a quantity of sample detergent granules to stand in a humidity chamber under a relative humidity of 100% and a temperature of 35° C. so as to attain a specified water content, charging the thus conditioned sample in a cylindrical container, forming an agglomerated test piece by applying a pressure of 20 g/cm$^2$ for 15 minutes, and measuring the strength of the force required for crushing or sub-dividing the thus-formed test piece.

What is claimed is:

1. A process for treating a granular detergent consisting essentially of from about 10 to 40% by weight of organic, water-soluble, anionic, synthetic surface active agent, from about 10 to 80% by weight of water-soluble inorganic detergent builder salts and up to less than about 50% by weight of nonionic and amphoteric, organic, water-soluble, synthetic surface active agents, water-soluble organic detergent builders, water-soluble sulfates and mixtures thereof, which comprises dry mixing with said granular detergent and adhering to the surfaces of the granules thereof from 0.5 to 5% by weight, based on the weight of said granular detergent, of fine particles of calcium sulfite having an average particle size of about 4 microns or less.

2. A process according to claim 1 wherein said granular detergent contains less than 15% by weight of polyphosphate inorganic detergent builder, calculated as $P_2O_5$.

3. A process according to claim 1 wherein said granular detergent contains from about 5 to about 20% by weight of alkali metal silicate inorganic detergent builder, said alkali metal silicate having the formula $M_2O.XSiG_2$, wherein X is a number of 2.0 to 3.6 and M is Na or K.

4. A process for treating a granular detergent consisting essentially of from about 10 to 40% by weight of organic, water-soluble, anionic, synthetic surface active agent, from about 10 to 80% by weight of water-soluble inorganic detergent builder salts and up to less than about 50% by weight of nonionic and amphoteric, organic, water-soluble, synthetic surface active agents, water-soluble organic detergent builders, water-soluble sulfates and mixtures thereof, which comprises dry mixing with said granular detergent and adhering to the surfaces of the granules thereof from 0.5 to 5% by weight, based on the weight of said granular detergent, of a material consisting essentially of (a) up to about 70% by weight of fine particles of synthetic zeolite having an average particle size of about 5 microns or less, and (b) the balance is fine particles of calcium sulfite having an average particle size of about 4 microns or less.

5. A process according to claim 4 wherein said granular detergent contains less than 15% by weight of polyphosphate inorganic detergent builder, calculated as $P_2O_5$.

6. A process according to claim 4 wherein said granular detergent contains from about 5 to about 20% by weight of alkali metal silicate inorganic detergent builder, said alkali metal silicate having the formula $M_2O.XSiO_2$, wherein X is a number of 2.0 to 3.6 and M is Na or K.

* * * * *